US011614296B2

(12) United States Patent
Bognar et al.

(10) Patent No.: US 11,614,296 B2
(45) Date of Patent: Mar. 28, 2023

(54) FIRING ASSEMBLY

(71) Applicants: Ginger Bognar, Fountain Hills, AZ (US); Attila Hunson, Fountain Hills, AZ (US)

(72) Inventors: Ginger Bognar, Fountain Hills, AZ (US); Attila Hunson, Fountain Hills, AZ (US)

( * ) Notice: Subject to any disclaimer, the term of this patent is extended or adjusted under 35 U.S.C. 154(b) by 0 days.

(21) Appl. No.: 17/534,651

(22) Filed: Nov. 24, 2021

(65) Prior Publication Data

US 2022/0244009 A1 Aug. 4, 2022

Related U.S. Application Data

(60) Provisional application No. 63/205,211, filed on Nov. 25, 2020, provisional application No. 63/205,210, filed on Nov. 25, 2020.

(51) Int. Cl.

| | |
|---|---|
| ***F41A 19/44*** | (2006.01) |
| ***F41A 19/10*** | (2006.01) |
| ***F41A 19/45*** | (2006.01) |

(52) U.S. Cl.

CPC ..... *F41A 19/44* (2013.01); *F41A 19/10* (2013.01); *F41A 19/45* (2013.01)

(58) Field of Classification Search

CPC ..... F41A 19/09; F41A 19/10; F41A 19/42; F41A 19/43; F41A 19/44; F41A 19/45

See application file for complete search history.

(56) References Cited

U.S. PATENT DOCUMENTS

| | | | | |
|---|---|---|---|---|
| 4,463,654 | A * | 8/1984 | Barnes | F41A 19/09 42/74 |
| 10,345,074 | B1 * | 7/2019 | Zamlinskiy | F41C 23/10 |
| 2006/0101693 | A1 * | 5/2006 | Langlotz | F41A 19/16 42/69.01 |
| 2014/0373418 | A1 * | 12/2014 | Hu | F41A 19/06 42/69.03 |
| 2015/0338181 | A1 * | 11/2015 | McAlister | F41A 19/09 29/525.08 |
| 2016/0153732 | A1 * | 6/2016 | Geissele | B23H 9/00 42/69.01 |
| 2017/0131051 | A1 * | 5/2017 | Albury | F41C 23/20 |
| 2018/0195822 | A1 * | 7/2018 | Jonsson | F41A 3/66 |
| 2019/0195588 | A1 * | 6/2019 | Lake | F41A 19/16 |

* cited by examiner

*Primary Examiner* — Gabriel J. Klein

(74) *Attorney, Agent, or Firm* — Schmeiser, Olsen & Watts, LLP

(57) ABSTRACT

The disclosed firing assembly for use in a firearm according to various aspects of the present technology may comprise a hammer configured to pivot between a cocked position and a firing position. The firing assembly may also comprise a hammer release assembly configured to releasably retain the hammer rearwardly in the cocked position. The hammer release assembly may comprise a housing axially connected to the firearm and a spring-loaded disconnector. In addition, the firing assembly may comprise a biasing component configured to bias the hammer and housing forwardly and upwardly, respectively. The firing assembly may further comprise a trigger assembly connected to the hammer release assembly via a trigger bar and configured to controllably operate the hammer release assembly.

11 Claims, 5 Drawing Sheets

FIRING ASSEMBLY

CROSS-REFERENCE TO RELATED APPLICATION

This application claims the benefit of U.S. Provisional Patent Application Ser. No. 63/205,210, filed on Nov. 25, 2020, and U.S. Provisional Patent Application Ser. No. 63/205,211, filed on Nov. 25, 2020, and incorporates the disclosure of each application in its entirety by reference.

BACKGROUND OF THE TECHNOLOGY

A firearm, such as a rifle, pistol, etc. is commonly used for combat, hunting, recreation, home defense, security, and law enforcement and is driven by rapidly expanding high-pressure gas produced by combustion of a chemical propellant, such as smokeless power, to discharge a bullet or other projectile through a barrel.

A conventional firearm's weight is not evenly distributed, making the firearm feel heavier than it actually is. In addition, the trigger weight of a conventional firearm is typically heavy, and thus a significant amount of force is needed to pull the trigger. Given that a heavy trigger weight requires more effort from the finger, hand, and forearm of a shooter, it can disrupt the straight-line aim of the shooter, thereby destabilizing the firearm and reducing accuracy, precision, timing, and safety of the firearm.

Accordingly, what is needed is a firearm with evenly distributed weight that is also ergonomic, compact, easy to maneuver and that has a lightweight trigger.

SUMMARY OF THE TECHNOLOGY

The disclosed firing assembly for use in a firearm according to various aspects of the present technology may comprise a hammer configured to pivot between a cocked position and a firing position. The firing assembly may also comprise a hammer release assembly configured to releasably retain the hammer rearwardly in the cocked position. The hammer release assembly may comprise a housing axially connected to the firearm and a spring-loaded disconnector. In addition, the firing assembly may comprise a biasing component configured to bias the hammer and housing forwardly and upwardly, respectively. The firing assembly may further comprise a trigger assembly connected to the hammer release assembly via a trigger bar and configured to controllably operate the hammer release assembly.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

DETAILED DESCRIPTION OF EXEMPLARY EMBODIMENTS

Figure 1:
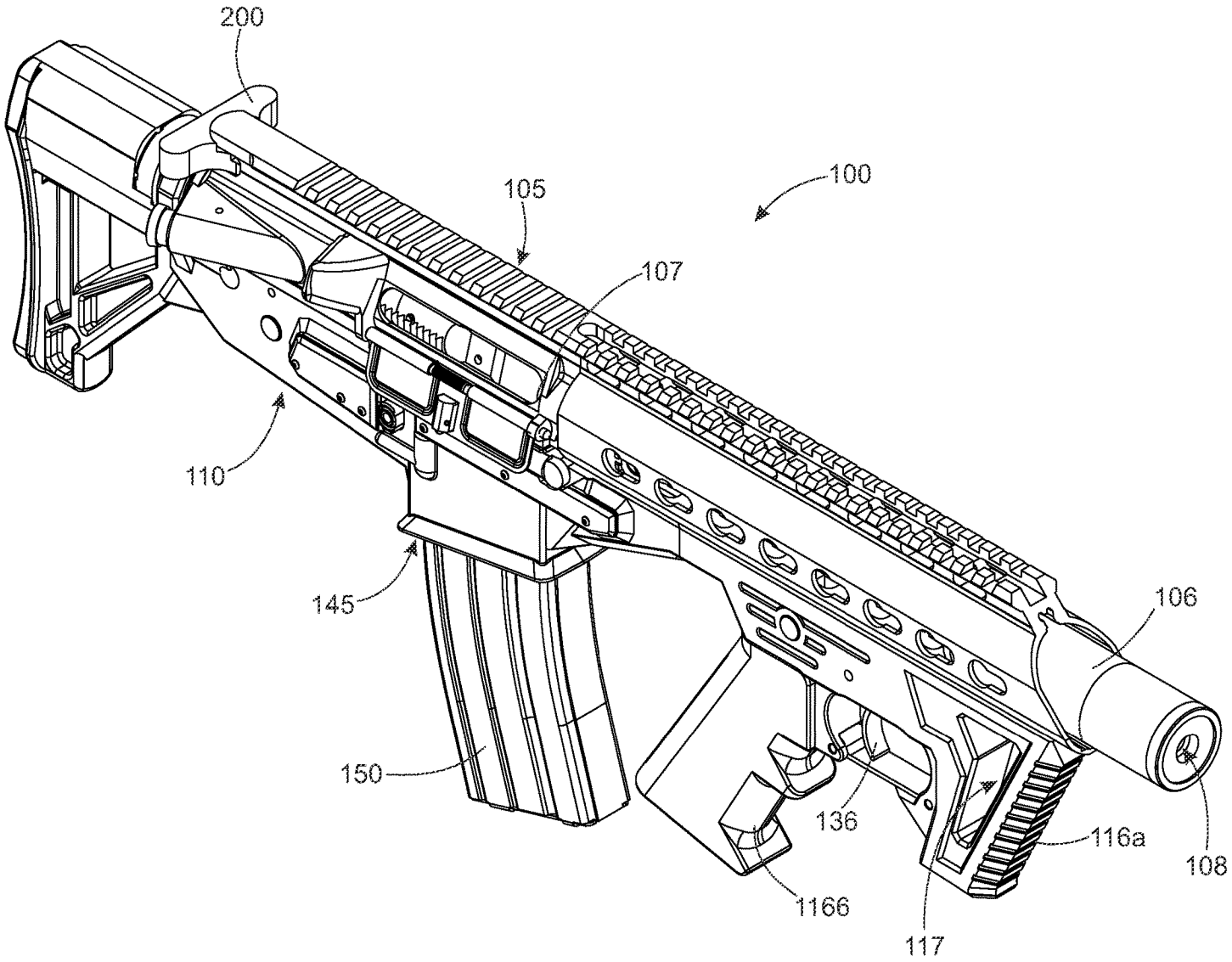
FIG. 1 representatively illustrates a perspective view of a firearm configured as a rifle in accordance with an embodiment of the present technology.
Figure 2:
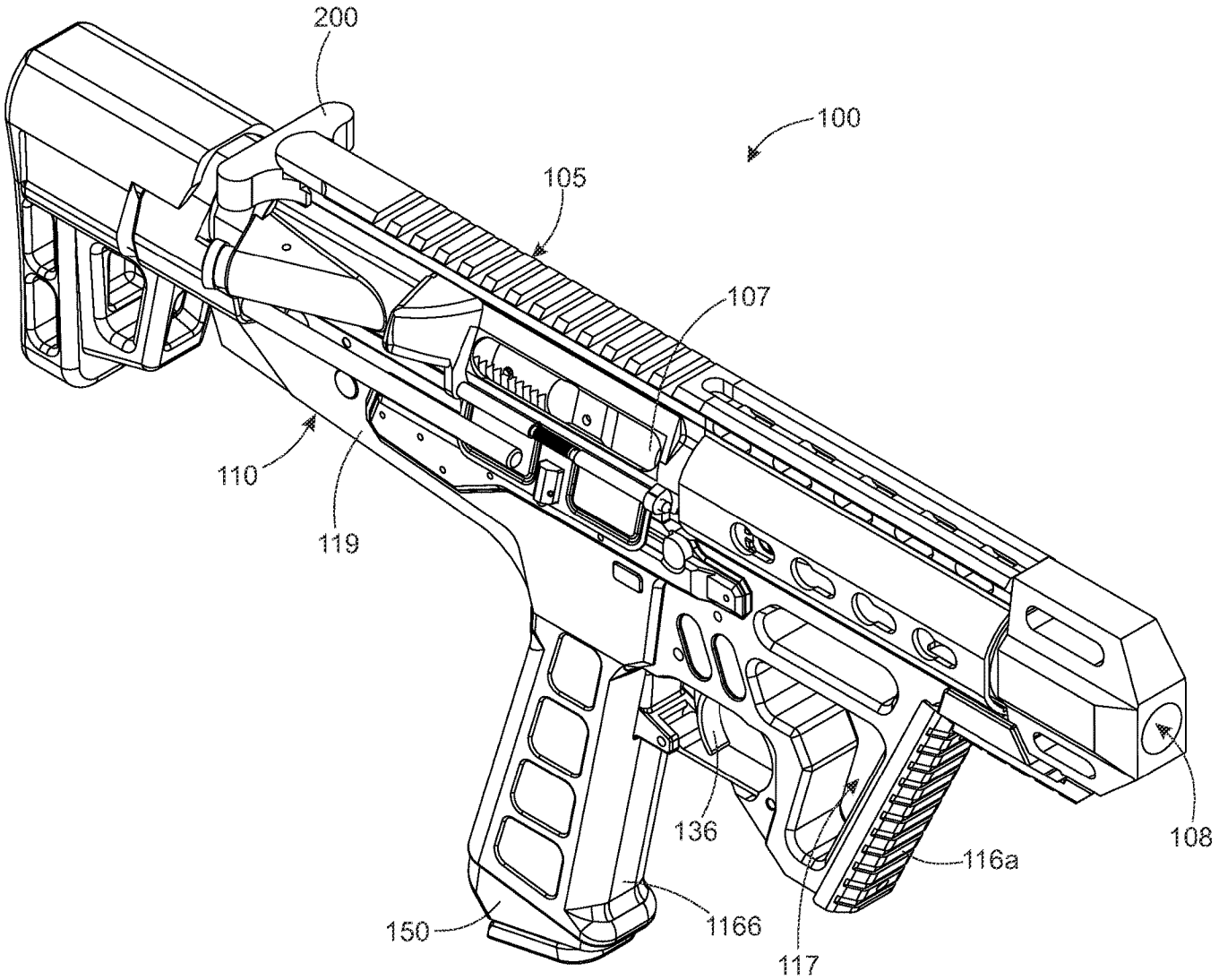
FIG. 2 representatively illustrates a perspective view of a firearm configured as a pistol in accordance with an embodiment of the present technology.

The present technology may be described herein in terms of functional block components. Such functional blocks may be realized by any number of components configured to perform the specified functions and achieve the various results. For example, the present technology may employ various axles, barrels, biasing components, chambers, coupling assemblies, coupling components, disconnectors, grips, hammers, hammer release assemblies, receivers, springs, triggers, trigger assemblies, trigger bars, and the like, which may carry out a variety of functions. In addition, the present technology may be practiced in conjunction with any number of firearms, and the firing assembly described herein is merely one exemplary application for the technology.

Referring to FIGS. 1-5, in various embodiments, a firearm 100 may comprise an upper receiver 105 and a lower receiver 110. The upper receiver 105 may comprise a barrel 106 which may comprise a chamber 107 and a muzzle 108. The lower receiver 110 may comprise a firing assembly 115 for use in the firearm 100. The firing assembly 115 may comprise a hammer 120, a hammer release assembly 125, a biasing component 130, a trigger assembly 135, and a trigger bar 140. In addition, the lower receiver 110 may comprise a receptacle cavity 145 for receivably engaging a magazine 150 capable of holding at least one cartridge (not shown) therein.

The hammer 120 may comprise a cavity 121 formed therein and a hook 122 and may be configured to pivot between a cocked position and a firing position. Specifically, the hammer 120 may be pivotally mounted to the firearm 100 via a first axle 123. The first axle 123 may be coupled to the biasing component 130 which may be arranged under tension to bias the hammer 120 forwardly to the firing position. In this regard, when the hammer 120 is moved to the cocked position and then released, the hammer 120 may be thrust forward by the biasing component 130 so that it may strike a firing pin (not shown), which in turn may strike a percussion cap (not shown) of the cartridge (not shown), thereby igniting gunpowder (not shown) contained in the cartridge (not shown) and discharging a bullet (not shown) from the cartridge (not shown). The bullet (not shown) may travel through the barrel 106 until it exists the barrel 106 via the muzzle 108. It will be appreciated that the hammer 120 may comprise any suitable hammer, such as a Mil-Spec AR-15 hammer, and the like.

The hammer release assembly 125 may comprise a spring-loaded disconnector 155 and a housing 160. The housing 160 may be axially connected to the firearm 100 via a second axle 126 and may rotate between a first position and a second position. The second axle 126 may be coupled to the biasing component 130 which may be arranged under tension to bias the hammer release assembly 125 upwardly to the first position. In this regard, when the hammer release assembly 125 is moved to the first position and then released, the hammer release assembly 125 may pivot downwardly to the second position by the biasing component 130.

In one embodiment, the housing 160 may comprise a bottom surface 165, a sidewall 167 extending from the bottom surface 165 to an open end 168 terminating in a peripheral rectangular-shaped edge 169. The sidewall 167 may comprise an outer surface 170 and an inner surface 172 that defines a receptacle cavity 174 in the housing 160. The spring-loaded disconnector 155 may be disposed within the receptacle cavity 174 of the housing 160 and axially connected to the firearm 100 via the second axle 126. The housing 160 may further comprise a first arm 175 which may be fixedly coupled to the outer surface 170 of the sidewall 167 and extending at a first angle upwardly therefrom.

The hammer release assembly 125 may be configured to releasably retain the hammer 120 rearwardly in the cocked position. For example, when the hammer 120 is moved to the cocked position and the housing 160 of the hammer release assembly 125 is in the first position, the cavity 121 of the hammer 120 may receivably engage the peripheral rectangular-shaped edge 169 of the housing 160 such that the hammer 120 may be prevented from rotating and/or pivoting to the firing position. In addition, the hammer release assembly 125 may be configured to release the hammer 120 from the cocked position. For example, when the housing 160 of the hammer release assembly 125 is moved from the first position to the second position, the peripheral rectangular-shaped edge 169 of the housing 160 may disengage or unlatch from the cavity 121 of the hammer 120 such that the hammer 120 may be thrust forward by the biasing component 130.

Figure 3:
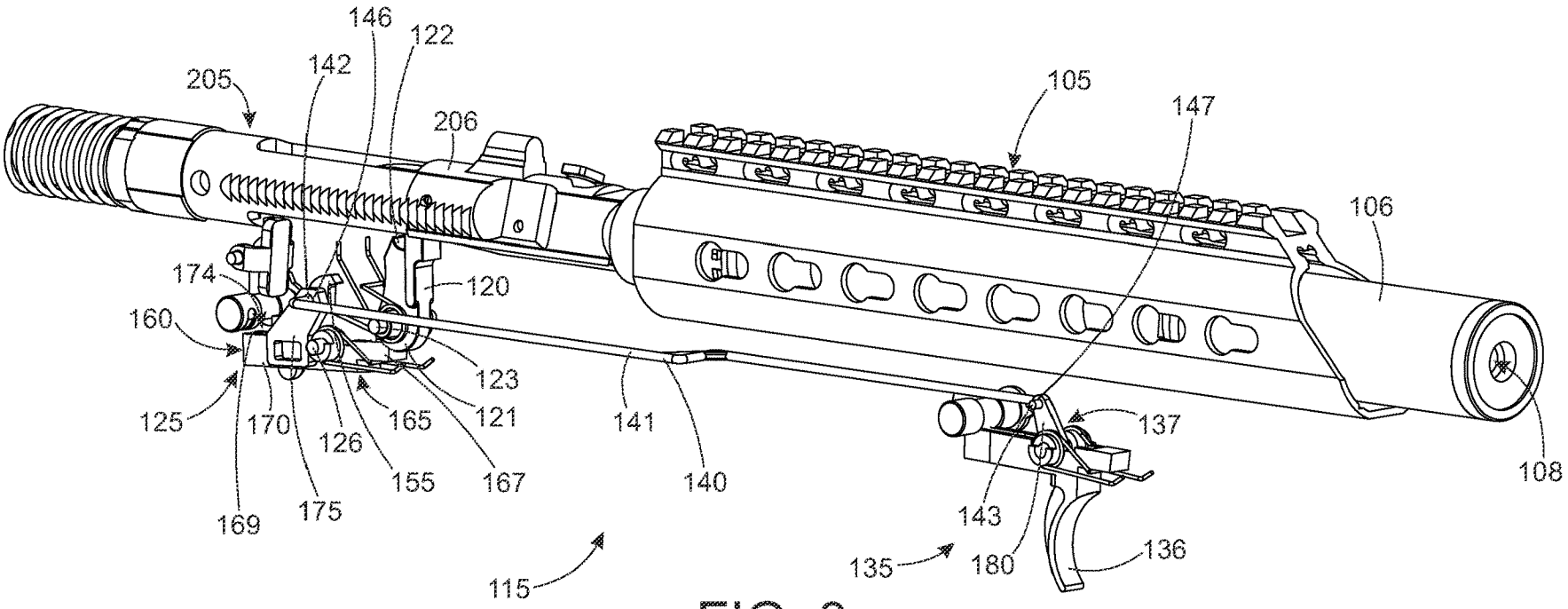
FIG. 3 representatively illustrates a perspective view of a firing assembly in accordance with a first embodiment of the present technology.

The trigger assembly 135 may be connected to the hammer release assembly 125 via the trigger bar 140 and may be configured to controllably operate the hammer release assembly 125. The trigger assembly 135 may comprise a trigger 136 and a coupling assembly 137 configured to connect the trigger 136 to the trigger bar 140. In one embodiment, the coupling assembly 137 may comprise a second arm 180 fixedly coupled to the trigger 136 and extending at a second angle upwardly therefrom, such as shown in FIG. 3. In another embodiment, and referring now to FIG. 4, the coupling assembly 137 may comprise a third arm 185 pivotally connected to the trigger 136 and extending at a third angle upwardly from the trigger 136, a fourth arm 190 pivotally connected to the third arm 185 and extending at a fourth angle upwardly from the third arm 185, and a fifth arm 195 pivotally connected to the fourth arm 190 and extending at a fifth angle upwardly from the fourth arm 190.

Figure 4:
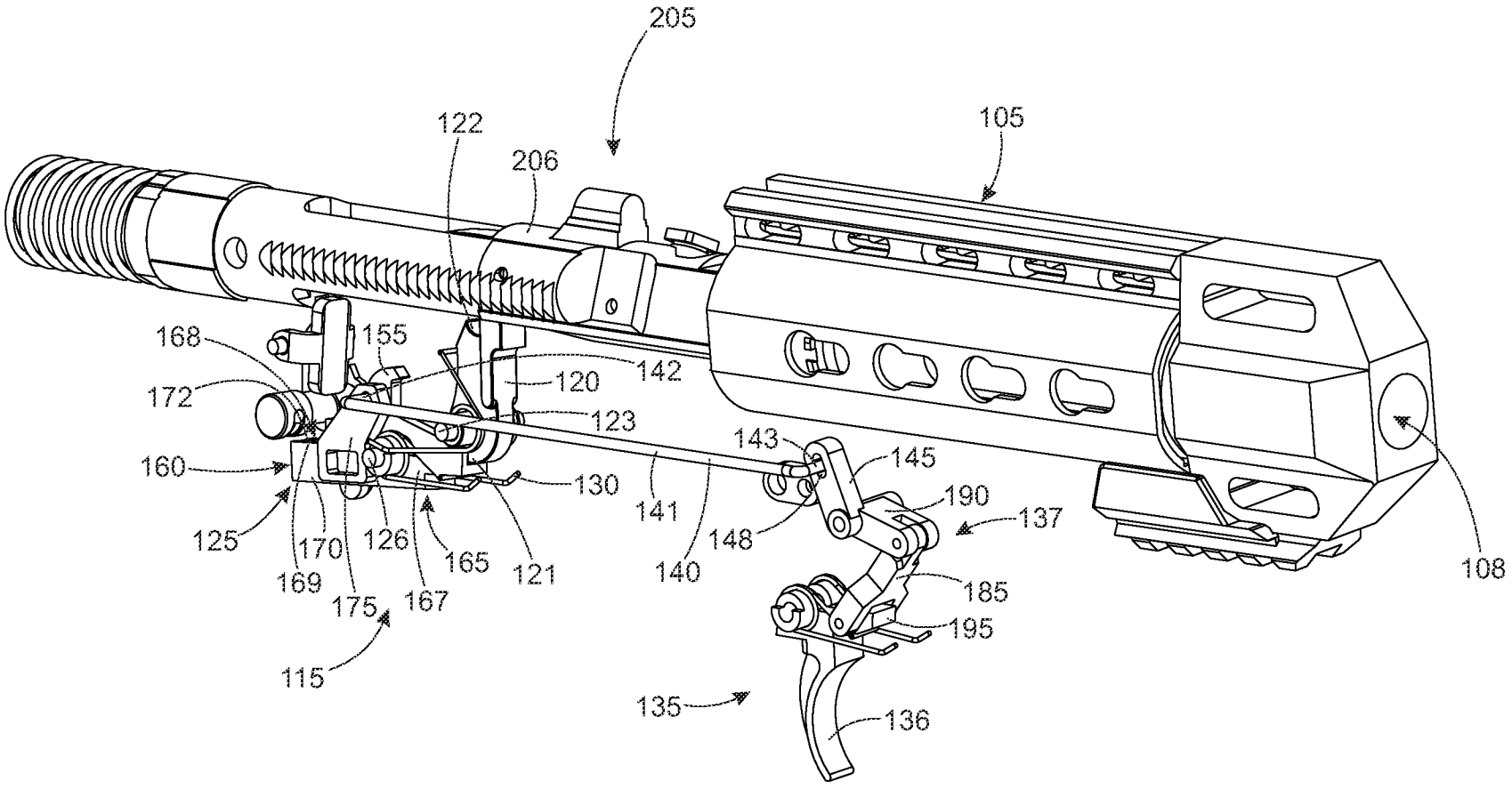
FIG. 4 representatively illustrates a perspective view of a firing assembly in accordance with a second embodiment of the present technology.

Each angle may be formed with respect to an axis perpendicular to the longitudinal axis of the firearm 100 and may be configured to reduce the amount of force required to pull the trigger 136. For example, the first angle, second angle, and third angle may each be between about 40 degrees and about 50 degrees. The fourth angle may be between about 40 degrees and about 80 degrees, and the fifth angle may be between about 40 degrees and about 50 degrees. Furthermore, the trigger assembly 135 may be positioned in front of the hammer 120 and the hammer release assembly 125, such as shown in FIGS. 3 and 4. In this regard, the weight of the firearm 100 may be evenly distributed, thereby improving accuracy, precision, timing, and safety of the firearm 100.

The trigger bar 140 may comprise a cylindrical-shaped body 141, a first end 142 and a second end 143. Each of the first and second ends 142, 143 may be bent, such as shown in FIGS. 3 and 4. In an exemplary embodiment, the first end 142 may protrude through a first aperture 146 located on the first arm 175 of the housing 160 and the second end 143 may protrude through a second aperture 147 located on the second arm 180 of the coupling assembly 137 to allow the trigger bar 140 to engage a first contact surface (not shown) of the first arm 175 and a second contact surface (not shown) of the second arm 180, respectively. In this regard, the trigger bar 140 may connect the hammer release assembly 125 to the trigger assembly 135. The trigger bar 140 may be decoupled from the first contact surface (not shown) of the first arm 175 to allow the trigger bar 140 to be withdrawn or otherwise detached from the first arm 175. Similarly, the trigger bar 140 may be decoupled form the second contact surface (not shown) of the second arm 180 to allow the trigger bar 140 to be withdrawn or otherwise detached from the second arm 180.

In another embodiment, the first end 142 may protrude through the first aperture 146 located on the first arm 175 of the housing 160 and the second end 143 may protrude through a third aperture 148 located on the fifth arm 195 of the coupling assembly 137 to allow the trigger bar 140 to engage the first contact surface (not shown) of the first arm 175 and a third contact surface (not shown) of the fifth arm 195, respectively. In this regard, the trigger bar 140 may connect the hammer release assembly 125 to the trigger assembly 135. The trigger bar 140 may be decoupled from the first contact surface (not shown) of the first arm 175 to allow the trigger bar 140 to be withdrawn or otherwise detached from the first arm 175. Similarly, the trigger bar 140 may be decoupled form the third contact surface (not shown) of the fifth arm 195 to allow the trigger bar 140 to be withdrawn or otherwise detached from the fifth arm 195.

In various embodiments, the upper receiver 105 may further comprise a charging handle 200 and a bolt carrier assembly 205. The charging handle 200 may be configured to slide between a forward position and a rearward position. The charging handle 200 may engage the bolt carrier assembly 205, such that when the charging handle 200 is pulled rearward and released, the bolt carrier assembly 205 may cock the hammer 120 in the first position on the rearward stroke. The bolt carrier assembly 205 may be configured to strip and/or grab the cartridge (not shown) from the magazine 150 and feed it to the chamber 107 on the forward stroke. The bolt carrier assembly 205 may comprise various components, such as a bolt 206, firing pin (not shown), gas key (not shown), cam pin (not shown), and an extractor (not shown). The bolt carrier assembly 205 may comprise any suitable bolt carrier assembly, such as a 7.62×39 AR-15 bolt carrier assembly, and the like.

Figure 5:
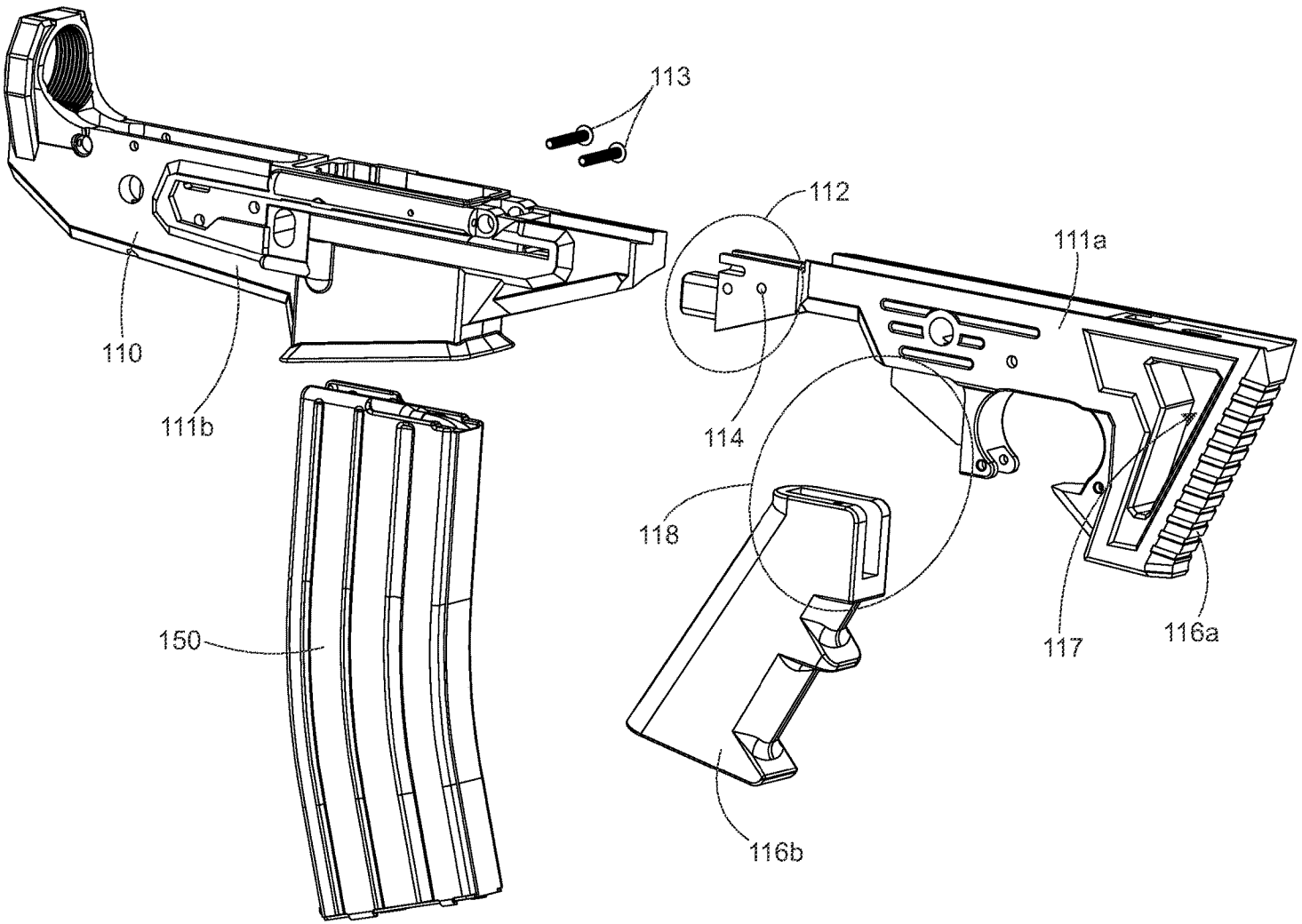
FIG. 5 representatively illustrates a perspective view of a lower receiver of the firearm illustrated in FIG. 1.

In one embodiment, and referring now to FIG. 5, the lower receiver 110 may comprise a first body 111*a* and a second body 111*b*, where the first body 111*a* and the second body 111*b* may be separate pieces that are adapted to be interconnected to each other. For example, in the case where the firearm 100 is configured as a rifle and the lower receiver 110 is a bullpup lower receiver, the first body 111*a* may be configured to be interconnected with the second body 111*b* by a tongue-and-groove connection 112. The first body 111*a* and the second body 111*b* of the lower receiver 110 may each comprise a plurality of apertures 114 for receiving a plurality of coupling components 113 therethrough. Specifically, each aperture 114 may receive a respective one of the plurality of coupling components 113 therethrough for coupling the first body 111*a* to the second body 111*b*. The first body 111*a* may, however, be connected with the second body 111*b* in any suitable manner.

The plurality of coupling components 113 may comprise any suitable mechanical connectors, such as rivets, screws, bolts, or any other combination thereof. As an example, in the case where the coupling components 113 are screws, the first body 111*a* may be coupled to the second body 111*b* by twisting each coupling component 113 into a locked position by pressing the coupling component 113 towards the firearm 100 and through its respective aperture 114 and then turning the coupling component 113 to lock into position. Conversely, the second body 111*b* may be decoupled from the first body 111*a* by twisting each coupling component 113 into an unlocked position and then disengaging the coupling component 113 from the first body 111*a*.

In addition, the first body 111*a* may comprise a first grip 116*a* and a second grip 116*b*. The first grip 116*a* may be integrally formed on the first body 111*a* and may comprise an aperture 117 therethrough for receiving a hand (not shown) of a shooter (no shown). The second grip 116*b* may be interconnected to the first body 111*a*. In one embodiment, the second grip 116*b* may be interconnected with the first body 111*a* of the lower receiver 110 by a tongue-and-groove connection 118. Further, in one embodiment, the first grip 116*a* may be located in front of the second grip 116*b*. It will be appreciated that modifications may be made to the lower receiver 110 without departing from the scope of the present invention. For example, in the case where the firearm 110 is configured as a pistol, the lower receiver 110 may comprise a single body 119. In this embodiment, the magazine 150 may be disposed within the second grip 116*b*.

In operation, the charging handle 200 may engage the bolt carrier assembly 205 of the upper receiver 105, such that when the charging handle 200 is pulled rearward and released, the bolt carrier assembly 205 may cock the hammer 120 on the rearward stroke and then strip and/or grab a cartridge (not shown) from the magazine 150 and feed it to the chamber 107 on the forward stroke. When the trigger 136 is pulled, the trigger bar 140 may move forward, which may cause the housing 160 of the hammer release assembly 125 to move from the first position to the second position, thereby releasing the hammer 120 from the cocked position. When the hammer 120 is released, the hammer 120 may be thrust forward by the biasing component 130 so that it may strike a firing pin (not shown), which in turn may strike a percussion cap (not shown) of the cartridge (not shown), thereby igniting gunpowder (not shown) contained in the cartridge (not shown) and discharging a bullet (not shown) from the cartridge (not shown). The bullet (not shown) may travel through the barrel 106 until it exits the barrel 106 via the muzzle 108.

As the bullet (not shown) is fired, and while the trigger 136 is depressed, redirected gas from the cartridge (not shown) is funneled back into the bolt carrier assembly 205. The gas fills a chamber (not shown) that's created by gas rings (not shown) and the bolt carrier assembly 205 and forces the bolt 206 back against a recoil spring (not shown). As the bolt 206 moves rearward, it acts on a cam pin (not shown), which twists the bolt 206 and unlocks it from the chamber 107. Because the spring-loaded disconnector 155 retains the hammer 120 when the trigger 136 is depressed, the bolt 206 may cycle rearward to extract the spent cartridge (not shown) and grab another cartridge (not shown) from the magazine 150 and feed the cartridge (not shown) into the chamber 107. The bolt 206 may engage a cam groove (not shown) and locking lugs (not shown) in the barrel 106. As the trigger 136 is released, the trigger bar 140 may move in a rearward direction, returning the hammer release assembly 125 to the first position and pushing the spring-loaded disconnector 155 upwardly, thereby unlatching the spring-loaded disconnector 155 from the hook 122 of the hammer 120. At this point, the hammer 120 may be returned to the cocked position and the cycle may repeat for subsequent shots.

In the foregoing specification, the technology has been described with reference to specific exemplary embodiments. Various modifications and changes may be made, however, without departing from the scope of the present technology as set forth in the claims. The specification and figures are illustrative, rather than restrictive, and modifications are intended to be included within the scope of the present technology. Accordingly, the scope of the technology should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims. Benefits, other advantages, and solutions to problems have been described above with regard to particular embodiments; however, any benefit, advantage, solution to problem or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes," or any variation thereof, are intended to reference a non-exclusive inclusion, such that a process, method, article, composition, or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied, or otherwise particularly adapted to specific environments, manufacturing specifications, design parameters or other operating requirements without departing from the general principles of the same.

The invention claimed is:

1. A firing assembly for use in a pistol, comprising:

a hammer configured to pivot between a cocked position and a firing position;

a hammer release assembly configured to releasably retain the hammer rearwardly in the cocked position and comprising:

a housing axially connected to the firearm; and a spring-loaded disconnector; and a trigger assembly connected to the hammer release assembly via a trigger bar and configured to controllably operate the hammer release assembly, wherein the trigger assembly comprises:

a trigger;

a third arm pivotally connected to the trigger and extending at a third angle upwardly from the trigger;

a fourth arm pivotally connected to the third arm and extending at a fourth angle upwardly from the third arm; and a fifth arm pivotally connected to the fourth arm and extending at a fifth angle upwardly from the fourth arm, wherein the fifth arm comprises a third aperture; and wherein:

the trigger bar comprises a cylindrical-shaped body, a first bent end, and a second bent end;

the first bent end and the second bent end of the trigger bar extend through a first aperture and the third aperture, respectively.

2. The firing assembly of claim 1, wherein the trigger assembly is positioned in front of the hammer and the hammer release assembly.

3. The firing assembly of claim 1, wherein the housing of the hammer release assembly comprises:

a bottom surface;

an open distal end opposite the bottom surface terminating in a peripheral rectangular edge;

a sidewall extending from the bottom surface to the peripheral rectangular edge, wherein the sidewall comprises an outer surface and an inner surface defining a receptacle cavity in the housing; and a first arm comprising the first aperture and coupled to the outer surface of the sidewall and extending at a first angle upwardly therefrom.

4. The firing assembly of claim 3, wherein the spring-loaded disconnector is disposed within the receptacle cavity of the housing and axially connected to the firearm.

5. A pistol, comprising:

an upper receiver, comprising:

a barrel; and a chamber; and a lower receiver, comprising:

a firing assembly, comprising:

a hammer configured to pivot between a cocked position and a firing position;

a hammer release assembly configured to releasably retain the hammer rearwardly in the cocked position and comprising:

a housing axially connected to the firearm; and a spring-loaded disconnector; and a trigger assembly connected to the hammer release assembly via a trigger bar and configured to controllably operate the hammer release assembly; and a receptacle cavity configured to receive a magazine therein, wherein the trigger assembly comprises:

a trigger; and a third arm pivotally connected to the trigger and extending at a third angle upwardly from the trigger;

a fourth arm pivotally connected to the third arm and extending at a fourth angle upwardly from the third arm; and a fifth arm pivotally connected to the fourth arm and extending at a fifth angle upwardly from the fourth arm, wherein the fifth arm comprises a third aperture; and wherein:

the trigger bar comprises a cylindrical-shaped body, a first bent end, and a second bent end; and the first bent end and the second bent end of the trigger bar extend through a first aperture and the third aperture, respectively.

6. The firearm of claim 5, wherein the trigger assembly is positioned in front of the hammer and the hammer release assembly.

7. The firearm of claim 5, wherein the housing of the hammer release assembly comprises:

a bottom surface;

an open distal end opposite the bottom surface terminating in a peripheral rectangular edge;

a sidewall extending from the bottom surface to the peripheral rectangular edge, wherein the sidewall comprises an outer surface and an inner surface defining a receptacle cavity in the housing; and a first arm comprising the first aperture and coupled to the outer surface of the sidewall and extending at a first angle upwardly therefrom.

8. The firearm of claim 7, wherein the spring-loaded disconnector is disposed within the receptacle cavity of the housing and axially connected to the firearm.

9. The firearm of claim 5, wherein the lower receiver comprises a first body and a second body, and wherein the first body and the second body are separate pieces that are adapted to be interconnected to each other.

10. The firearm of claim 9, wherein the first body is configured to be interconnected with the second body by a tongue-and-groove connection.

11. The firearm of claim 9, wherein the first body further comprises a first grip and a second grip, and wherein:

the first grip is integrally formed on the first body;

the second grip is adapted to be interconnected to the second body; and the first grip is located in front of the second grip.

* * * * *